United States Patent [19]

Churchman

[11] 4,104,751

[45] Aug. 8, 1978

[54] ENDBOARD AUXILIARY DEVICE FOR BEDS

[76] Inventor: M. Steele Churchman, 6215 Central Ave., Indianapolis, Ind. 46220

[21] Appl. No.: 760,931

[22] Filed: Jan. 21, 1977

[51] Int. Cl.[2] ..... A47C 21/02

[52] U.S. Cl. ..... 5/327 R; 5/319; 5/331

[58] Field of Search ..... 5/52, 53 R, 317, 319, 5/327 R, 329, 331; 247/411–416, 422

[56] References Cited

U.S. PATENT DOCUMENTS

| | | | |
|---|---|---|---|
| 1,151,894 | 8/1915 | Meinecke | 5/327 B |
| 3,402,409 | 9/1968 | Kain | 5/331 |
| 3,639,929 | 2/1972 | Ichise | 5/327 R |
| 4,022,502 | 5/1977 | Smith et al. | 5/327 R |

*Primary Examiner*—Casmir A. Nunberg
*Attorney, Agent, or Firm*—Robert A. Spray

[57] ABSTRACT

An easily and quickly installable and easily and quickly removable auxiliary device for beds, which is easily and very conveniently installable by slipping a frictional support tongue thereof between the mattress and box springs of the bed, no screws or other fastening means being required. Its convenience is heightened by movable connection means which provide that it is easily folded flat for transport and storage, although in use it is in a general T-shape.

5 Claims, 9 Drawing Figures

ENDBOARD AUXILIARY DEVICE FOR BEDS

The present invention relates to an endboard auxiliary device for a bed, and provides the general advantage of being able to quickly and easily add a footboard or headboard effect to a bed.

More particularly, the present invention provides an endboard auxiliary device for a bed, which device is instantly installable, without fasteners, without tools, and without any mechanical or assembly aptitude being required.

A still further achievement of the present invention is the provision of an endboard auxiliary device for a bed which is both instantly attachable and instantly removable, yet which provides a sturdy and stable bed footboard or headboard even though both instantly attachable and instantly removable and easily assembled onto a bed without tools or any auxiliary fastener means or devices.

Moreover, the present inventive concepts provide an endboard auxiliary device for a bed which in a travel or storage condition is substantially flat even though in its condition when applied to a bed is of a nature having significant height.

The present invention further provides an auxiliary device for a bed which is of economical and simple construction, yet which nevertheless provides the advantages mentioned.

The above description is of an introductory and generalized nature, particularly to mention the general objects and achievements and desirability of the present invention.

More particular and specific concepts, features, and details are set forth in the following more detailed description of an embodiment illustrative of the invention's concepts, taken in conjunction with the accompanying drawings.

In those drawings, which are somewhat schematic and diagrammatic in nature, it will be noted as follows.

Figure 1:
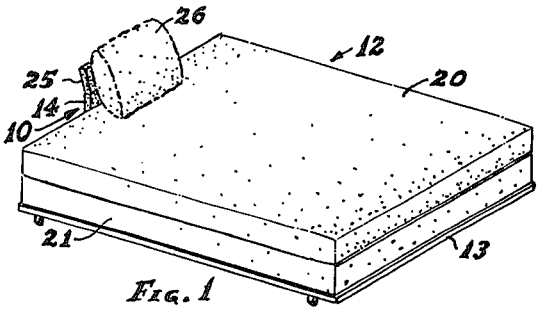
FIG. 1 is a pictorial illustration of a bed in which the endboard auxiliary of the present invention is shown in use as a bed headboard, the installation including an optional accessory shown in FIGS. 5 and 6.
Figure 2:
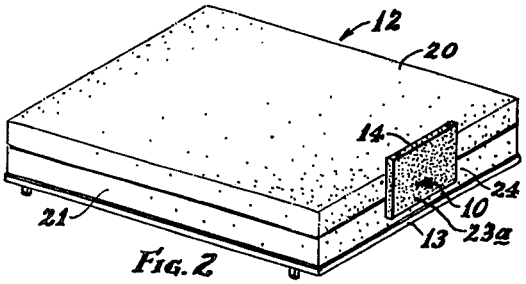
FIG. 2 is a pictorial illustration of the bed shown in FIG. 1, but showing illustratively the auxiliary endboard is in use as a footboard for the bed.

As shown in the drawings, the present invention provides an endboard auxiliary device 10 for a bed 12, its use illustrated in FIG. 1 as providing a bed headboard and in FIG. 2 as providing a bed footboard for a bed whose frame 13 does not provide them nor mounting means therefor.

The footboard use provides a desirable and sturdy yet easily and quickly attachable footboard useful in sexual relations, a footboard effect which used to be provided on many beds but which for many years has not been available on many beds of a common nature of merely a supporting frame often without even a headboard as well as a footboard.

The general components of the device 10 as shown are an endboard or an endboard means 14 which is secured to an endboard-support means 16, with a connection means 18 supportingly interconnecting the support means 16 and the endboard means 14.

The said endboard-support tongue or means 16 is shown as being relatively long and relatively thin, in a manner providing that in installation (FIG. 3) it may be slipped under the mattress 20 of the bed 12 above the box springs 21 thereof, without significantly raising the mattress 20, and long enough so as to be firmly held in place by the mattress-portion thereabove without being easily dislodged, and without requirement of any position-maintaining means other than the said thereabove mattress-portion and by the force reaction between it and the endboard-support means 16 without other fasteners.

Figure 4:
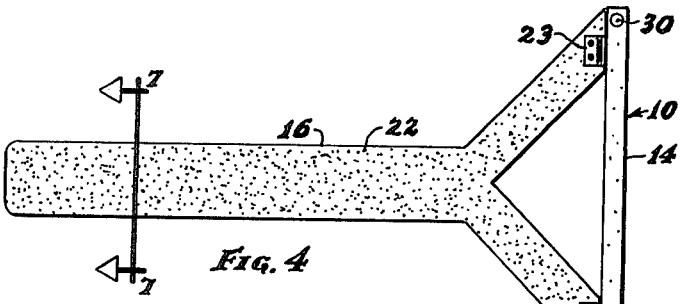
FIG. 4 is a plan view of the endboard auxiliary device shown in the preceding Figures.
Figure 7:
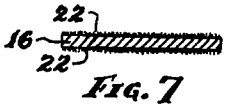
FIG. 7 is a cross-sectional view, taken generally along view-line 7—7 of FIG. 4, but in larger scale than FIG. 4.

As shown illustratively in FIGS. 4 and 7, the said endboard-support means 16 is provided on one or preferably both surfaces with a frictional surface whereby the force reaction between the said endboard-support means 16 and the overlying mattress-portion is caused to maintain the installed position of the said endboard-support means 16. For example, a thin layer of carpeting or rubberized fabric 22 is shown in FIGS. 4 and 7 for providing the frictional surface.

It will be particularly noted that the inventive concepts provide that the said supportinglyinterconnecting means 18 provide that the said endboard means 14 and the said endboardsupporting means 16 are movably interconnected (here pivotally by hinges 23), and there are provided movement-blocking means which block against movement of the said endboard means relative to the said endboard-supporting means 16. In the form shown, this blocking is achieved by the lower portion **23*a* of the said endboard means 14 extending below the level of the said endboard-supporting means 16 to abut bed portions 24 lower than the said endboard-supporting means 16** to provide the said movement-blocking effect.

The pivotal nature advantageously permits the device to be folded flat for transport and storage.

In use, however, it is of a general T-shape (a letter "T" lying on its side), which takes advantage of the support achieved by the bed-portion 24 of the box springs 21 abutting the endboard-portion **23*a* to block swinging of the endboard means 14**.

Figure 5:
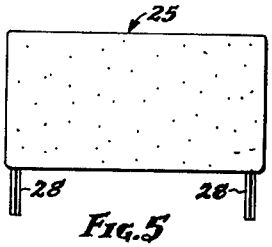
FIG. 5 is an elevational view, in smaller scale, of a headboard accessory device, as shown in FIG. 1 as installed onto the endboard auxiliary, in larger scale than FIG. 1 although smaller scale than FIGS. 3 and 4.
Figure 6:
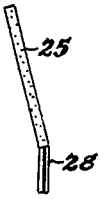
FIG. 6 is an end elevational view of the headboard accessory shown in FIG. 5.

An endboard accessory 25 is shown in FIGS. 1, 5, and 6, particularly useful when the auxiliary device 10 is used as bed headboard, such as to support a pillow 26. The endbord accessory 25 is illustrated as readily connectible to the endboard auxiliary device 10 by downwardly-extending pins 28 which are optionally receivable in receiving holes 30 provided in the upper portions of the endboard means 14.

Figure 3:
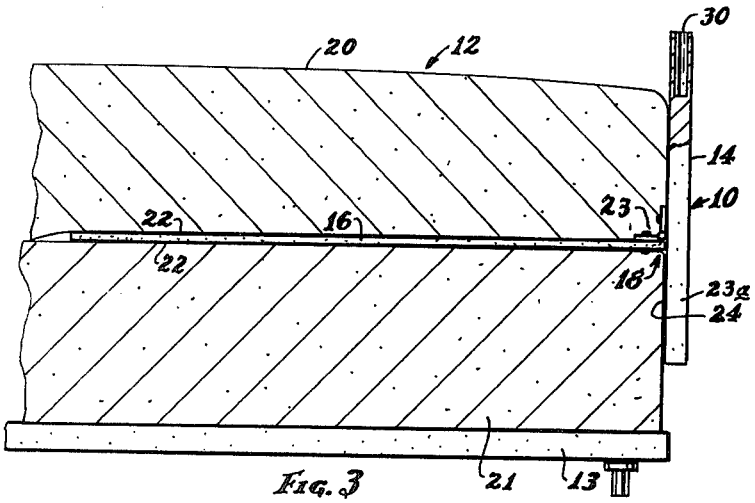
FIG. 3 is a longitudinal cross-sectional detail view in much larger scale, showing the auxiliary endboard in its installation as a footboard as in FIG. 2.
Figure 8:
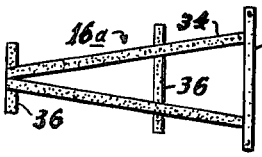
FIGS. 8 nd 9, respectively, are plan and side elevational views of a support means of an auxiliary endboard device of a second embodiment, in substantially reduced scale.
Figure 9:
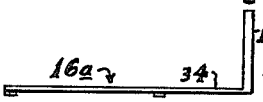

A second embodiment is illustrated in FIGS. 8 and 9, in which the support tongue 16, of FIGS. 3 and 4 is replaced by a frame **16*a* comprised of a pair of outwardly diverging longitudinal members 34, from the outer end of which the endboard means 14***a* extends upwardly, the frame members 34 being shown as braced and tied together by transverse straps 36.

SUMMARY

It is thus seen that an endboard auxiliary device for beds provides the advantages of easy and convenient and quick attachment and removal, even without tools, and requires no mechanical or assembly skill. Yet it nevertheless provides a sturdy and secure bed footboard or headboard, providing advantages in sexual relations, in supporting a pillow, etc., in the manner or effect of an assembled footboard or headboard. It is particularly advantageous in that it is useful in conjunction with existing and economical bed sets which do not have one or both endboards, and is easily transported and carried and stored. A special advantage is that it is conveniently used on beds, such as of hotels or motels, which are used only temporarily, even by a person who if purchasing a bed would purchase one with integral headboard and/or footboard.

Accordingly, it will thus be seen from the foregoing description of the invention according to this illustrative embodiment, considered with the accompanying drawings, that the present invention provides a new and useful bed endboard which achieves these desirable and advantageous goals, the novel endboard device having desired advantages and characteristics, and accomplishing its intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown. As an example, the word "mattress" is intended in the broad sense of any pad member under which the tongue of the endboard may be slipped; and the word "bed" is intended to mean not only a bed but any other object upon which a person would recline, as a couch or divan.

I claim:

1. An endboard auxiliary device for a bed, comprising:

an endboard means;

an endboard-support means;

means supportingly interconnecting the support means and the said endboard means;

the said endboard-support means being relatively long and relatively thin, in a manner providing that in installation it may be slipped under the mattress of the bed without significantly raising the mattress and long enough so as to be firmly held in place by the mattress-portion thereabove without being easily dislodged, and without requirement of any position-maintaining means other than the said thereabove mattress-portion and by the force reaction between it and the endboard-support means without other fasteners;

in a combination in which the said supportingly-interconnecting means provide that the said endboard means and the said endboard-supporting means are movably interconnected, and there are provided movement-blocking means which block against movement of the said endboard means relative to the said endboard-supporting means;

in which there is also provided an endboard accessory which effectively raises the height of the endboard, there being means provided which releasably secure the same to the said endboard means; and in which the said releasable securing means of the endboard accessory and the endboard means comprise pin members extending downwardly from the said endboard accessory and fit into receiving holes provided in the upper portion of the said endboard means.

2. The invention as set forth in claim 1 in a combination in which the said endboard-support means is provided on at least one surface with a frictional surface whereby the force reaction between the said endboard-support means and the overlying mattress-portion is caused to maintain the installed position of the said endboardsupport means.

3. The invention as set forth in claim 2 in a combination in which both surfaces of the said endboard-support means are provided to have a frictional surface to assure a positionmaintaining engagement of it with the mattress and/or underlying support of the mattress.

4. The invention as set forth in claim 1 in a combination in which the said movable interconnection is of pivotal nature, and the said endboard means extends below the level of the said endboard-supporting means to abut bed portions lower than the said endboardsupporting means to provide the said movementblocking effect.

5. The invention as set forth in claim 1 in a combination in which the said endboard auxiliary device in use is of a general T-shape (that is the general shape of a letter "T" lying on its side), providing that one leg thereof provides the said endboardsupport means, and the lower portion of the other leg provides an abutment engageable with a lower portion of the bed to block outward swinging of the upper portion of the endboard in use.

* * * * *

UNITED STATES PATENT OFFICE

CERTIFICATE OF CORRECTION

Patent No. 4,104,751 Dated August 8, 1978

Inventor(s) M. STEELE CHURCHMAN

It is certified that error appears in the above-identified patent and that said Letters Patent are hereby corrected as shown below:

Col. 1, Line 62: The letters "nd" should be the word "and"

All of the following words should have hyphens as here indicated, rather than being written all as one word:

| | | |
|---|---|---|
| Col. 2 | Line 38: | supportingly-interconnecting |
| Col. 2 | Line 40: | endboard-supporting |
| Col. 4 | Line 32: | endboard-support |
| Col. 4 | Line 36: | position-maintaining |
| Col. 4 | Line 42: | endboard-supporting |
| Col. 4 | Line 43: | movement-blocking |
| Col. 4 | Line 49: | endboard-support |

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*